United States Patent [19]

Skinner

[11] 4,084,303

[45] Apr. 18, 1978

[54] FORMING ROLL FOR ROLLING CYLINDRICAL BODIES FROM CYLINDRICAL ROD STOCK, AND A METHOD OF MAKING THE SAME

[75] Inventor: Kenneth Charles Skinner, Longlevens, England

[73] Assignee: Helipebs Limited, Ore, England

[21] Appl. No.: 757,322

[22] Filed: Jan. 6, 1977

[30] Foreign Application Priority Data

Jan. 7, 1976 United Kingdom ..... 571/76

[51] Int. Cl.[2] ..... B21H 8/02

[52] U.S. Cl. ..... 29/148.4 D; 72/71; 72/103

[58] Field of Search ..... 72/71, 98, 103, 104; 29/148.4 B, 148.4 D, 121.4, 127

[56] References Cited

U.S. PATENT DOCUMENTS

| | | | |
|---|---|---|---|
| 672,664 | 4/1901 | Bornemann | 72/71 |
| 3,466,910 | 9/1969 | Carlsen | 72/71 |
| 3,878,701 | 4/1975 | Skinner | 72/71 |

*Primary Examiner*—Lowell A. Larson

*Attorney, Agent, or Firm*—Jacobi, Lilling & Siegel

[57] ABSTRACT

An improved forming roll for forming cylindrical metal slugs from cylindrical rod stock is characterized in that the roll has a helical groove defined by a rib the radial height of which and the axial dimension of which increase along the length of the roll, the groove between successive helices of the rib having a cylindrical base the axial length of which is so dimensioned that the volume of metal enclosed by the groove, in use, is substantially constant.

There is also described a novel method for making such a forming roll.

4 Claims, 5 Drawing Figures

0°
1080°
ANGLE OF ROTATION
A
B
C
D
AXIAL DIMENSION

FORMING ROLL FOR ROLLING CYLINDRICAL BODIES FROM CYLINDRICAL ROD STOCK, AND A METHOD OF MAKING THE SAME

BACKGROUND OF THE INVENTION

This invention concerns an improved forming roll for rolling cylindrical metal bodies from cylindrical rod stock, and a method of making the same.

It is known to prepare rolled metal cylindrical bodies or slugs, for use in ore crushing or as blanks for the production of bearing rollers, by feeding a heated cylindrical metal rod longitudinally between a pair of forming rolls, in a direction generally parallel to the axes of the forming rolls, at least one of the rolls having a helical metal rib which serves to part the cylindrical rod into cylindrical slugs as the rod proceeds axially along the gap between the forming rolls. The known grooved forming rolls for use in such a method have the disadvantage that their efficiency in parting the slugs from the metal rod is relatively low, and on the one hand the forming roll is subjected to uneven load and relatively high wear, whereas, on the other hand the metal rod is subjected to undue deformation during the initial stage of the parting operation so that the metal slugs produced are of relatively low quality and the wastage of metal is relatively high.

It is an object of the present invention to provide a forming roll having a profile which enables more efficient production of metal slugs and having a higher quality and to the required shape and dimension than those hitherto produced by a method of the above type.

SUMMARY OF THE INVENTION

According to the invention there is provided a forming roll having a helical groove the base of which is cylindrical and has a substantially constant radius with reference to the rotary axis of the forming roll, said groove being defined by a helical rib of which the radial height from the base of said groove and the width along the axis of said roll increase along the axial length of the forming roll, and the axial length of said cylindrical base of the groove being so dimensioned that the volume of metal enclosed by said groove, in use, is substantially constant along the length of the forming roll.

A forming roll in accordance with the invention has the advantage that an initial relatively small axial width of the helical rib defining said groove ensures that the length of metal rod initially engaged between adjacent crests of the rib corresponds substantially to the volume of metal required to produce a slug of the desired dimensions, the parting of the slug from the rod being effected progressively by the combined action of an increasing penetration of the rod by the helical rib and a stretching of the rod due to the increasing axial separation of adjacent helices of the groove.

In a forming roll of the above construction, it will be noted that since the increased axial width of the helical rib is not accompanied by a corresponding reduction in axial length of the groove defined thereby, there is an effective increase in the pitch of the helical groove along the length of the forming roll. The production of a forming roll having such a profile presents considerable difficulties in the machining steps required to form the profile thereof, and therefore in accordance with a further feature of the invention there is provided a method for the production of such a forming roll.

The method of the invention comprises the steps of, preparing an initial grooved roll having a cylindrically based helical groove of constant pitch along the length of the roll, the axial length of the rib defining said groove being substantially greater than that required in the final forming roll, and the axial length of the cylindrical base of the helical groove being substantially less than that finally required; machining the leading edge of the helical rib thus formed, starting from one end of the roll, in order to reduce the pitch of the leading edge of said rib over at least an initial part of the length of the forming roll; machining the trailing edge of said rib, starting from said one end of the forming roll, in order correspondingly to reduce the pitch thereof over an initial part of the length of the forming roll, whilst reducing the axial length of the rib to the desired value; and machining the remainder of the trailing edge of said helical groove along the length of the forming roll at a pitch substantially corresponding to the pitch of the original blank, in order to determine the finally desired axial dimensions of said helical groove and said rib.

BRIEF DESCRIPTION OF THE DRAWINGS

The invention is illustrated by way of example in the accompanying drawings, in which.

DESCRIPTION OF THE PREFERRED EMBODIMENT

Figure 1:
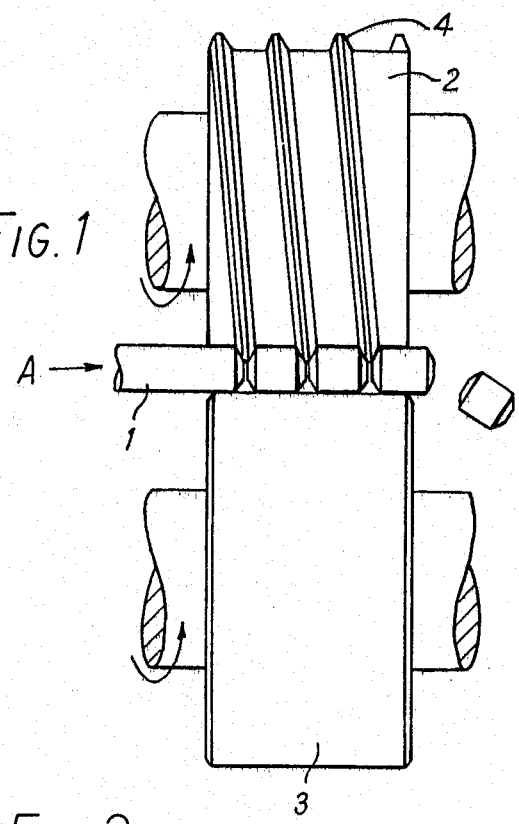
FIG. 1 is an elevation in diagrammatic form of a method of forming metal slugs from heated cylindrical rod stock.
Figure 2:
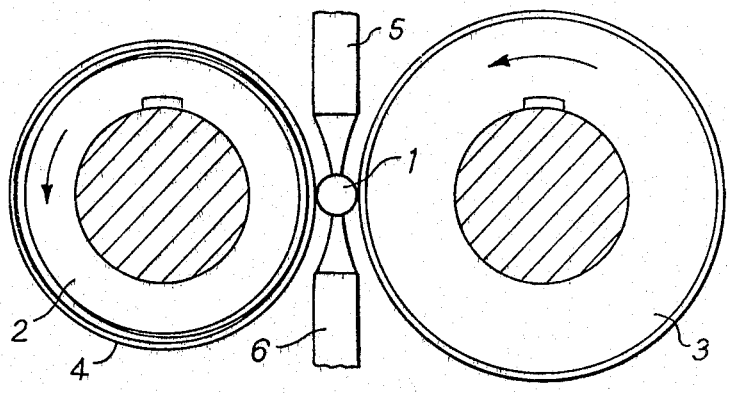
FIG. 2 is an end view in the direction of the arrow A in FIG. 1.

Referring to FIGS. 1 and 2 of the drawings, there is shown a known method of forming metal slugs from cylindrical metal rod stock. A heated cylindrical metal rod 1 is fed axially between a pair of forming rollers 2 and 3, arranged to rotate in the same direction, the roller 2 having a helical metal rib 4, which serves to part the metal rod into shorter length slugs, as the rod moves axially between the rolls. The rod 1 is retained between the forming rolls by means of guide members 5 and 6. The diameter of the plain roll 3 and the forming roll 2 are of a ratio so that the rod 1 is biased in a direction counter to the direction of rotation of the forming roll 2, in order to compensate for the force applied to the bar 1 by the roll 2 during deformation thereof.

It will be seen that the helical rib 4 is of substantially constant pitch and profile, and thus has the disadvantage that the energy involved in deformation of the metal rod stock is substantially greater at the initial end of the forming roll, owing to the fact that substantially the whole of the deformation of the rod takes place as it initially engages the helical rib. Thus, wear on the leading end of the forming roll is correspondingly greater than the remainder thereof, and there is also a substantial wastage of metal.

Figure 3:
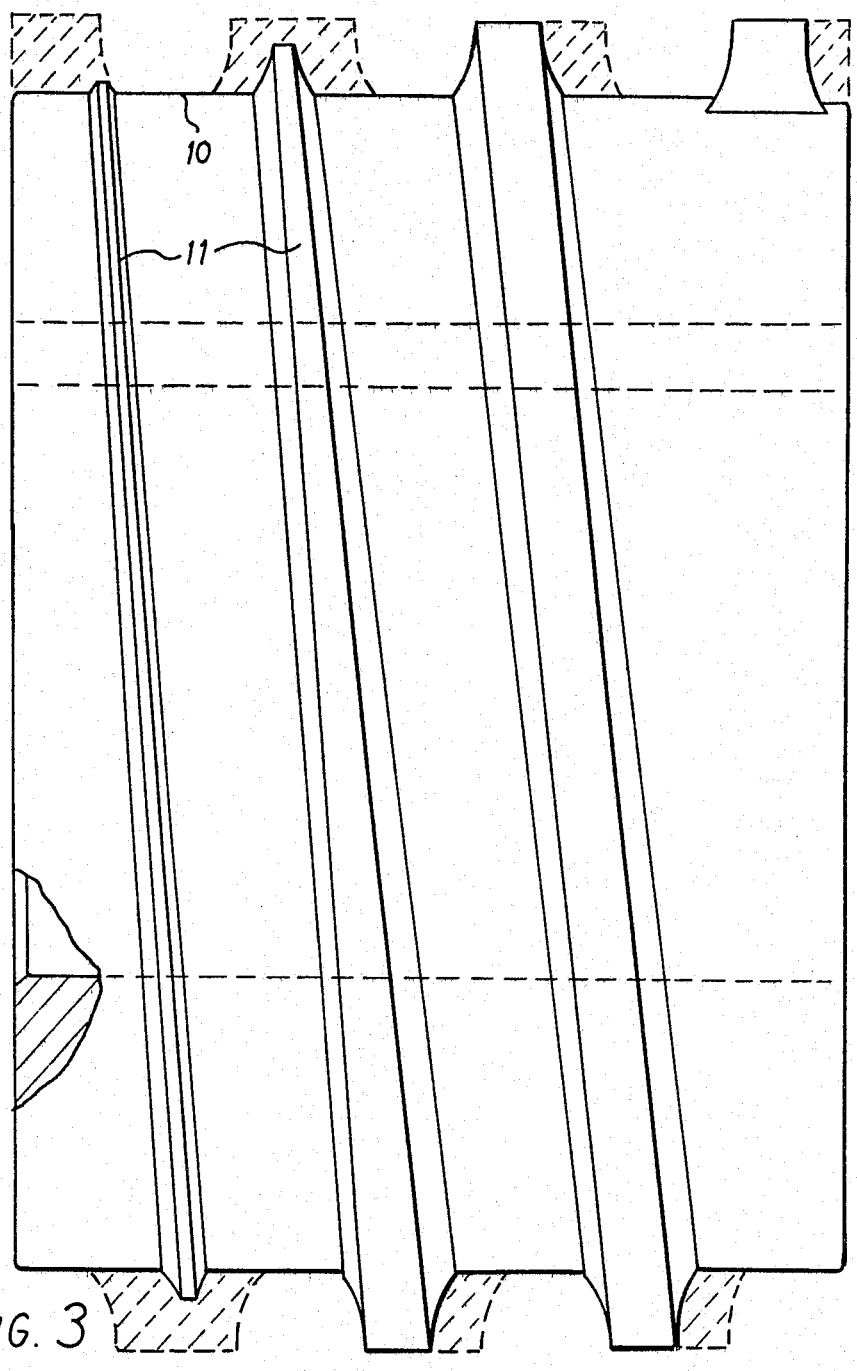
FIG. 3 is an elevation of a forming roll in accordance with the present invention.

Referring now to FIG. 3 of the drawings, there is shown an embodiment of forming roll in accordance with the present invention. As can readily be seen from the drawing in the forming roll in accordance with the invention a helical groove has a cylindrical base portion 10, which is of substantially constant radius, and of substantially constant axial length along the length of the forming roll. A helical rib 11 defining said groove is initially of relatively small radial height and axial width at the leading end of the forming roll and increases in height and width progressively along the axial length of the forming roll. This arrangement has the effect that during initial engagement of a heated metal rod by the forming roll, the axial length of the portion of the rod engaged between successive helices of the rib 11 corresponds substantially to the axial length of the base 10 of the groove and the volume of that portion of the rod engaged by the initial end of the rib 11 being relatively small. Also the deformation of the rod is relatively small. As the metal rod progresses along the length of the forming roll, from the left to the right hand end as viewed in the drawing, the volume of metal engaged within the helical groove remains substantially the same, whereas the height and width of the rib increase. Thus, deformation of the metal rod is effected by a combination of the compression thereof by the crest of the rib, and the axial stretching thereof by the flanks of adjacent portions of the rib 11 as the helices of the grooves 10 move axially apart from one another.

Figure 4:
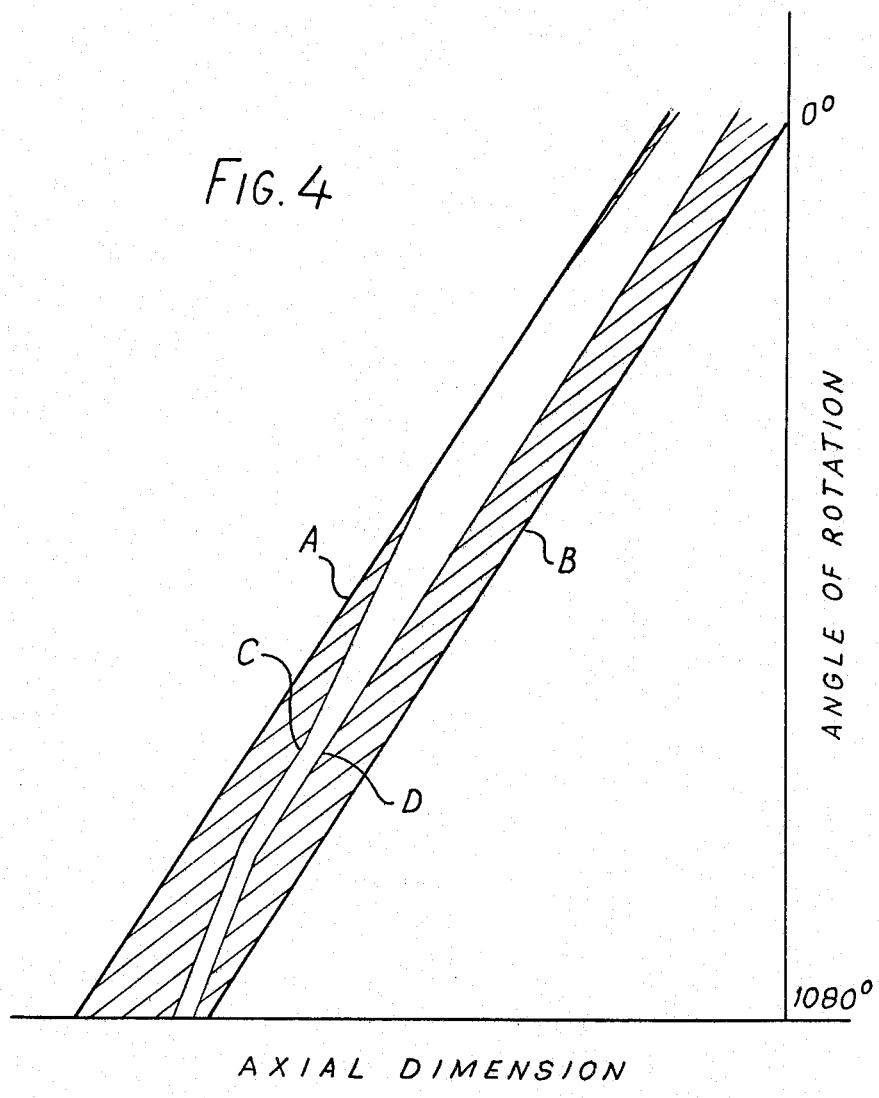
FIGS. 4 and 5 are graphs illustrating the relative dimensions of the forming roll shown in FIG. 3.

The manufacture of a forming roll as described above will now be described in more detail. Machining of the forming roll commences with the production of a roll having a helical groove of substantially constant pitch, the rib between adjacent helices of the groove being of substantially constant axial width and radial height. The profile of the initially grooved roll is indicated in FIG. 3 in broken lines. By comparing the profile illustrated in broken lines with the profile of the finished forming roll, it will be seen that the desired final form of the roll is achieved by relieving opposite sides of the initially formed rib, to induce the axial width thereof, whilst at the same time changing the pitch. The operations involved will be understood more clearly, by referring to FIG. 4, which comprises a graph illustrating the pitch of leading and trailing edges of respective sides of the initial forming roll and the finished forming roll respectively. The ordinate of the graph indicates the angle of rotation of a flank of the helical rib around the forming roll, whereas the abscissa indicates the axial displacement of the flank along the forming roll. Referring to the graph, it will be seen that the lines A and B represent the positions of the leading and trailing flanks of the helical rib formed on the initial helically grooved roll as shown in dotted lines in FIG. 3. The angle of the lines indicates the pitch of the rib. The lines C and D in FIG. 4 indicate the positions of the leading and trailing flanks of the helical rib of the finished forming roll, and the shaded areas between lines A and C and lines D and B thus indicate the amount of metal to be removed during formation of the finished roll from the initial regularly grooved roll. It will be seen that the lines C and D each consist of a number of sections each of constant pitch, so that the production of the finished roller can be effected relatively simply in a number of steps, in each of which machining of a portion of the roll is effected at constant pitch. Thus the pitch required for each machining operation can be relatively easily determined by changing appropriate gear ratios in a helical milling machine.

Figure 5:
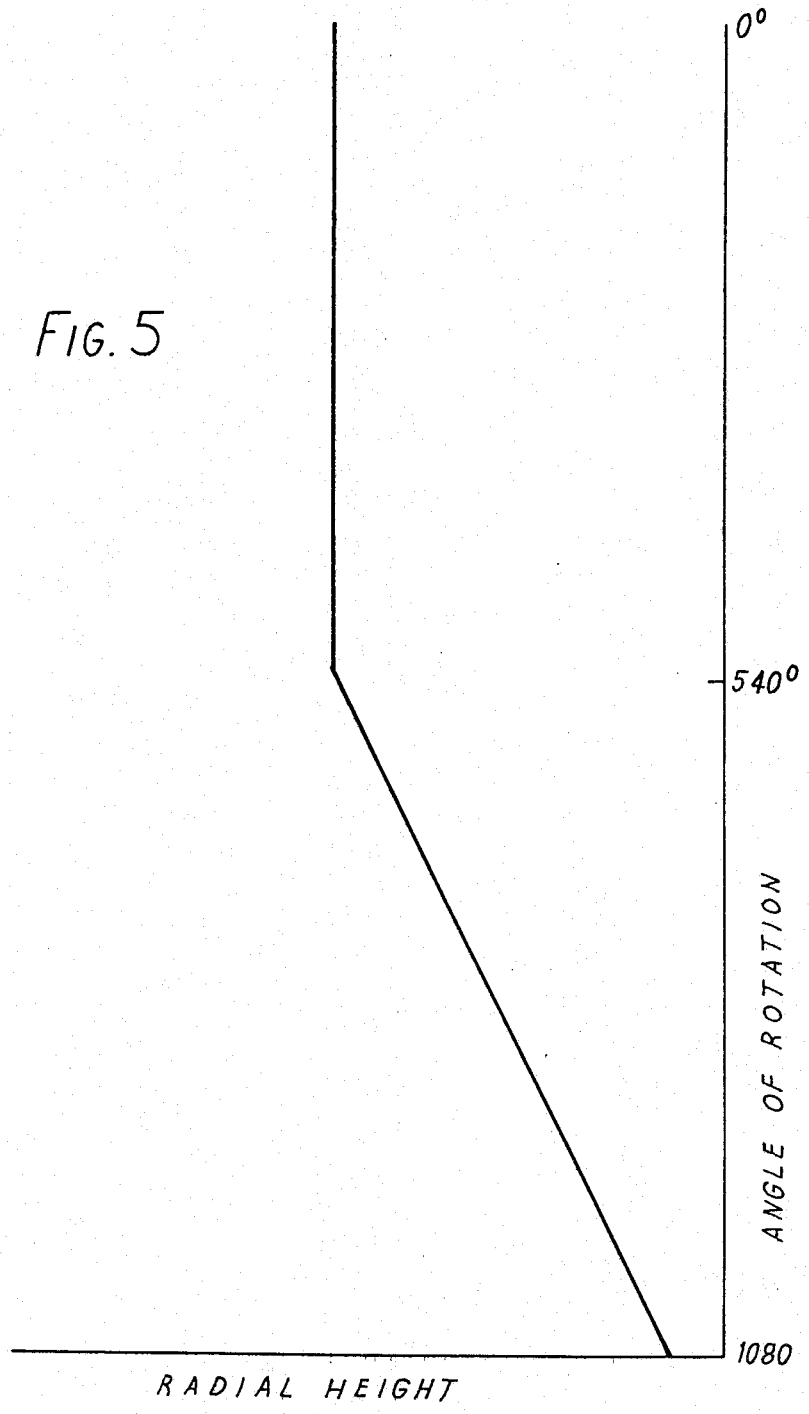

FIG. 5 is a graph which illustrates the radial height of the rib 11 in relation to its angular position on the forming roll, and it will be seen that the height of the rib regularly increases in order to achieve a progressive penetration of the heated metal rod during formation of metal slugs therefrom. The machining of the rib to achieve the desired radial profile can be effected at any desired stage of manufacture of the forming roll as is convenient. Preferably, when the forming roll is to be used with a plain cylindrical backing roll, as shown in FIGS. 1 and 2, the final height of the rib 11 is slightly greater than the radius of the cylindrical slug to be formed thereby.

By means of a forming roll constructed as described above there is provided a helical rib the axial width and radial height of which can be adjusted to effect penetration of the heated metal bar in the most efficient manner, so that the energy applied in deforming the bar is relatively uniform along the length of the forming roll, and the load and corresponding wear on the forming roll is substantially uniform. At the same time, by variation in pitch of the flanks of the rib, as described above, the profile and dimensions of the groove enclosed by said rib may be adjusted to enclose the appropriate volume of metal required for the formation of a metal slug of the desired dimensions. For example, the axial length of the cylindrical portion 10 of the groove may either be maintained substantially constant, with a corresponding substantially constant profile defined by the adjacent portions of the rib 11, or may be adjusted slightly in conjunction with an adjustment of the profile of the adjacent portions of the rib 11, provided that the volume of metal enclosed by the adjacent helices of the rib 11 corresponds substantially to that of the length of metal rod initially engaged by the helical groove at the starting end of the roll.

According to one arrangement, the profile of the lateral flanks of the rib 11 may be varied in inclination to produce a slight axial compression of an initially parted portion of the metal rod, in which case the axial length of the base 10 of the groove may be increased slightly to accommodate metal so displaced.

I claim:

1. A forming roll for forming cylindrical metal slugs from cylindrical rod stock, comprising a helical groove having a cylindrical base portion of constant radius and substantially constant axial length, said groove being defined by a helical rib of progressively increasing height for parting said rod stock into slugs, said helical rib having leading and trailing flanks of which the pitch is changed progressively along the axial length of the roll in stages including a first stage occupying an arc of not more than 360° wherein the pitch of the trailing flank of the rib is smaller than the pitch of the remainder of said trailing flank, and a second stage wherein the pitch of the leading flank has a smaller pitch than that of the trailing flank whereby the axial length of the helical rib is increased along the axis of the roll, and wherein the said pitch of the trailing flank in the first stage and the said pitch of the leading flank in the second stage are approximately the same and the respective portions of said flanks are axially opposed to one another, whereby the increase in axial length of the said rib is accommodated substantially without reduction in the axial length of the helical groove.

2. A forming roll as claimed in claim 1 wherein the said stages in which the pitches of the flanks of the rib are changed include a third stage, located between the first and second stages, and a fourth stage located beyond the second stage, and wherein the pitches of the leading and trailing flanks of the rib in both of the second and fourth stages are the same.

3. A forming roll as claimed in claim 2, wherein said stages include a fifth stage wherein the pitch of the leading flank of the rib is greater than that of the trailing flank, whereby the axial length of the rib is reduced and the axial length of the base portion of said groove bounded by the leading flank is correspondingly increased, and wherein the profiles of the flanks of the rib adjacent said increased length base portion are varied so that the volume of metal enclosed by said groove in use is substantially constant.

4. A method of producing a forming roll for forming cylindrical metal slugs from cylindrical rod stock, including the steps of; preparing an initial grooved roll having a cylindrically based helical groove of constant pitch along the length of the roll, the axial length of the rib defining said groove being substantially greater than that required in the final forming roll, and the axial length of the cylindrical base of the helical groove being substantially less than that finally required, machining the trailing flank of said rib over an arc of not more than 360° extending from the starting end of said rib in order to reduce the pitch thereof, machining the remainder of the trailing flank to reduce the axial length of the rib while retaining substantially its original pitch; and machining at least that portion of the leading flank of the rib axially facing the reduced pitch portion of the trailing flank in order correspondingly to reduce its pitch, whereby a progressive increase in axial length of the said rib is obtained while maintaining the axial length of said groove substantially constant.

* * * * *